United States Patent [19]

Maier

[11] Patent Number: 4,986,344

[45] Date of Patent: Jan. 22, 1991

[54] SUPPORT MEANS FOR THE MANIFOLD DUCTS OF A HEAT EXCHANGER

[75] Inventor: Karl Maier, Karlsfeld, Fed. Rep. of Germany

[73] Assignee: MTU Motoren und Turbinen- Union Munchen GmbH, Munich, Fed. Rep. of Germany

[21] Appl. No.: 500,515

[22] Filed: Mar. 27, 1990

[30] Foreign Application Priority Data

Apr. 7, 1989 [DE] Fed. Rep. of Germany ..... 3911257

[51] Int. Cl.[5] ..... F28F 9/00

[52] U.S. Cl. ..... 165/67; 165/78; 165/82; 165/144; 165/173; 165/176

[58] Field of Search ..... 122/235 D, 511; 165/67, 165/78, 82, 144, 145, 173, 176

[56] References Cited

U.S. PATENT DOCUMENTS

| | | | |
|---|---|---|---|
| Re. 21,270 | 11/1939 | Feldmeier | 165/78 X |
| 498,699 | 5/1893 | Shaw | 122/511 X |
| 798,684 | 9/1905 | LeDuc | 122/511 X |
| 1,893,135 | 1/1933 | Feldmeier et al. | 165/78 X |
| 2,055,200 | 9/1936 | Karmazin | 165/82 |

FOREIGN PATENT DOCUMENTS

| | | | |
|---|---|---|---|
| 31297 | 10/1925 | France | 122/511 |

*Primary Examiner*—Martin P. Schwadron
*Assistant Examiner*—Allen J. Flanigan
*Attorney, Agent, or Firm*—Ladas & Parry

[57] ABSTRACT

A heat exchanger having two mainfold ducts extending in parallel, adjacent relation connected to each other by heat exchange tubes. The manifold ducts are formed by a plurality of duct segments axially aligned one after the other in sealed relation and a support frame is arranged externally of the manifold ducts and is secured to and supports the duct segments individually at one of their ends. Each duct segment is secured to the frame at one of its ends while its other end is guidably supported and allowed to axially expand and contract relative to the end of the adjacent duct segment. This provides favorable resistance to the loads developed during operation as well as simple dismantling of the heat exchanger.

18 Claims, 4 Drawing Sheets

SUPPORT MEANS FOR THE MANIFOLD DUCTS OF A HEAT EXCHANGER

FIELD OF THE INVENTION

The invention relates to a heat exchanger having two manifold ducts extending in parallel, adjacent relation to one another which are connected to a matrix of heat exchange tubes arranged in bundles, the manifold ducts being constructed as axially aligned duct segments secured in fluid-tight relation.

BACKGROUND AND PRIOR ART

Such a heat exchanger, has been disclosed in DE-OS No. 3803 947 and its U.S. equivalent Ser. No. 303,921 and DE-OS No. 3803948 and its U.S. equivalent Ser. No. 303,942 in which the duct segments are secured together by tension means arranged inside the ducts, said tension means being formed as tension rods or as tension tubes. In this way, both the manufacture of the heat exchanger and its maintenance are considerably simplified, since only individual duct segments must be processed or replaced. Also, there are no sealing problems created when the hot gases flow externally of the manifold ducts, since the ducts heat up first to a greater extent than the internally arranged tension means, and thus tightness at the joints of adjacent duct segments is guaranteed during the start-up phase of operation.

A disadvantaqe of this arranqement is that the tension means in the ducts causes a considerable flow resistance to the fluid flowing in the ducts, and this resistance may lead to a considerable reduction in the total efficiency of the plant driven by the heat exchanger. A further disadvantage is that during certain operating conditions, for example, a reduction of full load to partial load, due to an externally reduced flow temperature, the manifold ducts cool and contract whereas the tension means inside the ducts remain at the previous high temperature whereby the tensioning is of the duct segments is relaxed and leakage may occur under unfavorable circumstances between adjacent duct segments.

A further disadvantage is that the above described construction is suitable only for heat exchangers of smaller construction size, since with larger heat exchangers the load on the manifold ducts due to the intrinsic weight of the matrix of heat exchange tubes and the dynamic loads that occur would be so high that several supports would be necessary in the radial direction along the length of each manifold duct. With rigid joining flanges for the duct segments, a closed tube connection is produced of considerable structural length. Because of temperature gradients over the cross section of the ducts, a bending of the ducts along the longitudinal axis occurs. Due to this bending and due to its multiple supports, the support forces are indeterminate. This may lead to prevention of longitudinal expansion and considerable loads will be developed over the cross section of the ducts.

Considerable forces are produced in a closed tube construction by dynamic loads acting in the axial direction of the manifold ducts and these forces place a considerable load on the ducts. A further disadvantage is that manifold ducts, which have at least one closed end, and whose axial support is arranged at a substantial distance from this closed end will have considerable load developed due to axial forces acting on the closed end, of the duct as a consequence of internal pressure.

This has a substantial effect on the strength of the support tubes which have a perforated cross section.

SUMMARY OF THE INVENTION

An object of the present invention is to provide a heat exohanqer having support means for the manifold ducts which provides maximized resistance to the forces acting on the manifold ducts during operation, particularly dynamic forces in all three mutually perpendicular directions.

The heat exchanger according to the invention comprises two substantially parallel manifold ducts connected together by a plurality of heat exchange tubes arranged in bundles extending axially of the ducts, each duct comprising a plurality of axially aligned duct segments sealably connected to one another and support frame means external of the ducts for guidably supporting each of the duct segments in the region of the ends thereof at which one duct segment faces the next. The support frame means comprises means for securing each duct segment at one end thereof to said support frame means, longitudinal support means extending parallel to the ducts and a plurality of axially spaced support carriers to which said longitudinal support means is secured, said support carriers supporting said manifold ducts in said regions where the ends of said ducts segments face one another.

The principal advantages of the support means of the invention are that the duct segments may freely expand in the axial direction due to the single end attachment to the support frame means, whereby distortions due to thermal expansions may be avoided. The bending of the ducts along their longitudinal axes, caused by the temperature gradients over the duct cross section, occurs only over the length of the individual duct segments and is consequently essentially smaller in magnitude than in the heretofore known long ducts secured together by flanges. It is further of advantage that distortion at the joints of the duct segments is no longer present due to the force distribution to separate duct segments, and thus the support is clearly determined.

A further essential advantage is that the length changes caused by thermal expansions are considerably smaller and thus there are smaller thermal expansion differences to be taken up by gaskets. The expansion of a single duct segment is thus smaller and the seal is simpler in construction than in a single continuous duct. Due to the axial attachment of the individual duct segments at only one end, the duct expands only in one direction.

A further advantage of the arrangement according to the invention is that in the individual duct segments there are no additional stresses that occur in the axial direction, i.e., the axial forces caused by the internal pressure against the end duct segment is not transferred to the neighboring duct segments. Also, the resistance to the dynamic load in the axial direction is simplified, since only the smaller mass of the duct segment, and the heat exchange tube matrix attached thereto must be resisted. Moreover, a free internal fluid flow through the duct is assured, which leads to a reduction in flow losses and thus to an improved efficiency. The advantages of the previously know arrangements, i.e., easy replacement of individual damaged components is also obtained in the construction according to the invention.

In a suitable embodiment of the invention, the support means includes two support tubes arranged on both sides parallel to the manifold ducts, said support tubes being joined together by a number of axially spaced support carriers supporting the two manifold ducts in the region of the joints of the duct segments and wherein each duct segment is attached at one end to a support carrier. This construction of the support frame means assures a favorable resistance to the weight and dynamic forces that occur during operation, particularly in the radial direction, while at the same time, the attachment of the individual duct segments may be obtained with a minimal weight of the support frame means. In addition, resistance to the forces in the axial direction and guidance in this direction can be obtained.

Preferably, axial elastic ring seals are provided between the individual duct segments. which seals are advantageously constructed as metal bellows (E seals). In this way a seal for very large sealing spaces is assured with simultaneous good temperature resistance of the seal. An essential advantage of the elastic sealing rings is that they can accommodate the axial movements that arise between the adjacent ends of the duct segments due to fluctuations in temperature.

The support tubes preferably consist of individual support tube segments, which are arranged between two support carriers for each segment and are securely joined to the carriers, preferably by means of bolts. Due to this division of the support tubes into individual segments, as in the case of the manifold ducts, it is possible to advantageously manufacture the support carriers, and in cases of repair, it is simple to dismantle the heat exchanger and replace defective elements. The support carriers may be formed as metal plates, which have two bore holes for the traversal of the duct segments, or they may be designed as cast elements with apertures for purposes of saving material. Alternatively, it is also possible to produce the support tubes in a continuous manner, i.e., from one piece, if this leads to a simplification of the production process or an improvement in the force transfer.

The support tubes advantageously have a round or oval cross section, and in the case of the oval cross section, the tubes are oriented with their larger bending resistance moment axis facing the anticipated load. It is also conceivable to make one of the two support tubes oval and the other round or to use other cross-sectional shapes, for example, square or rectangular configurations. The support tubes are preferably arranged on both sides of the manifold ducts such that the longitudinal axes of the ducts and the tubes lie in a common plane (an axial plane). This has the advantage that the heat exchanger may be suspended with the manifold ducts arranged horizontally above one another such that the ducts can be impacted externally by vertically flowing hot gases. The weight forces of the heat exchanger are thus resisted by the upper and lower support tubes, whereby the maximum rigidity of the support fame means is utilized in the vertical direction.

In another advantageous embodiment of the invention, reinforcing plates are joined to each successive pair of support carriers and extend perpendicularly to the axial plane midway between the support tubes. This arrangement increases the flexural strength of the entire heat exchanger around the transverse axis in the axial plane. Further, tensile loads are also transferred in the axial direction by this means.

At the joints between neighboring duct segments, guide sleeves are preferably provided that surround the segments, which sleeves are rigidly joined to the support carriers, and on which are means for attachment to one of the two duct segments. The guide sleeves serve for axial guidance of the duct segments in the case of thermal expansion and contraction, and also for the attachment of the sealing component between the individual duct segments. The guide sleeves may thus be welded to the support carriers or be attached by bolts to the latter, and are designed as short as possible for purposes of reducing weight. The means for attaching the guide sleeves to the duct segments preferably comprises key and slot components which assure an easy replaceability.

According to another embodiment according to the invention, connecting fittings are employed for coupling the manifold ducts to the fluid inlet and outlet connections. It is possible to provide only one connecting fitting for each duct, or to provide two connecting fittings, which lie opposite each other with respect to the duct. The advantage of the latter arrangement is in the favorable fluid flow through the duct since half of the fluid medium must flow in each direction, and the flow losses which arise along the length of the duct are reduced. Also, a more uniform flow duct cross-section is obtained when compared to fluid supply at only one end of the duct. The same advantages arise if the connecting fittings are placed at both axial ends of each duct.

DETAILED DESCRIPTION OF PREFERRED EMBODIMENTS

Figure 1:
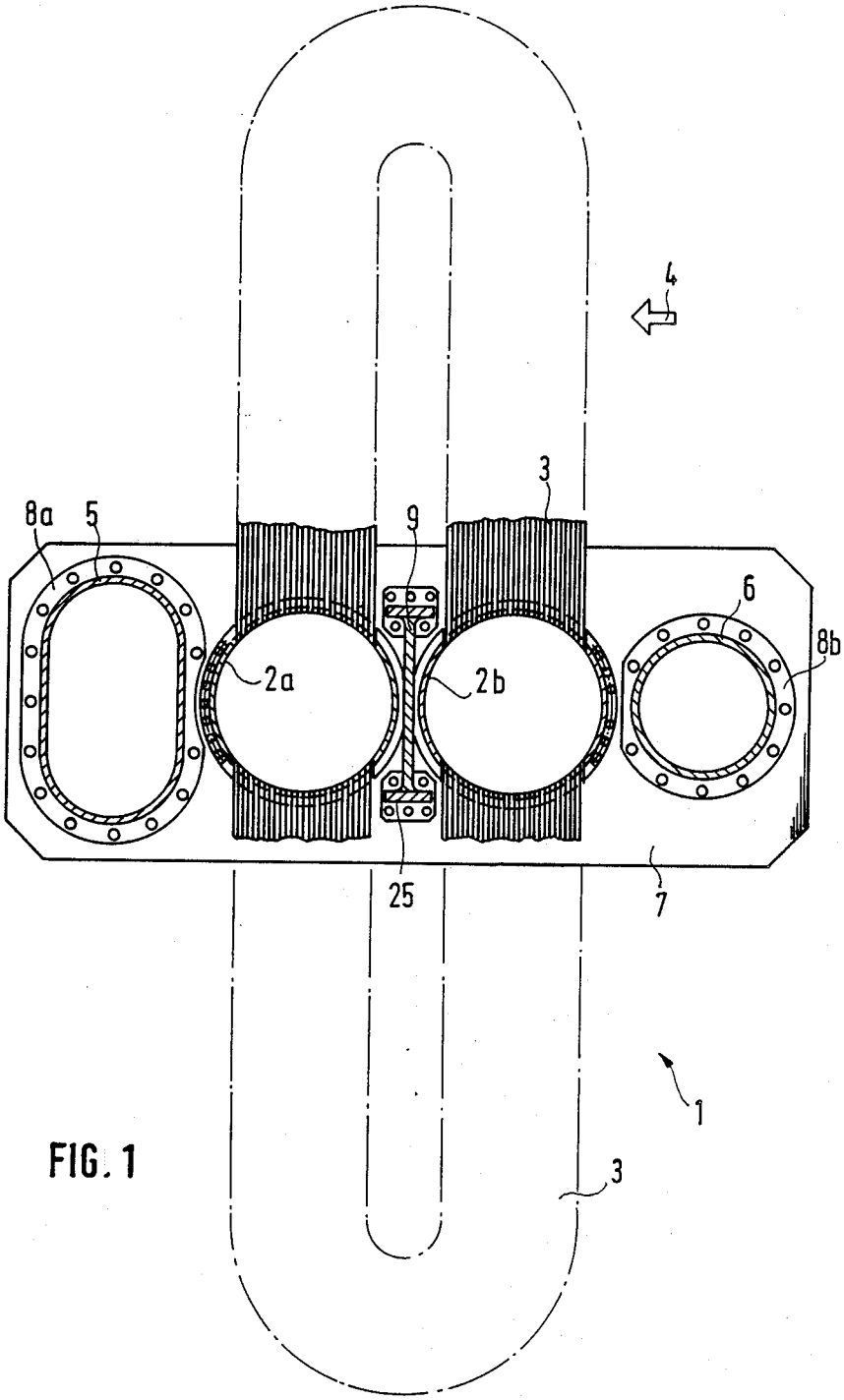
FIG. 1 is a transverse cross section, partly broken away, through a heat exchanger according to the invention.

FIG. 1 shows a heat exchanger which comprises two manifold ducts 2*a*, 2*b* which are joined to and connected by matrixes 3 of U-shaped heat exchange tubes at both sides of the ducts 2*a*, 2*b*. During operation, a fluid flows from duct 2*a* through the two tube matrixes 3 to duct 2*b* and the fluid is heated in the heat exchange tubes by flow therearound of hot gases in the direction 4. The ducts 2*a*, 2*b* and the matrixes 3 of heat exchange tubes are supported by a support frame means comprising two parallel support tubes 5, 6 extending on both sides of manifold ducts 2*a*, 2b in parallel relation to the ducts, the support tubes 5, 6 being joined together by a plurality of axially spaced support carriers 7. The support tubes 5 and 6 have respective attachment flanges 8*a*, 8*b*, by which the support tubes are secured to the support carriers 7. Midway between the two manifold ducts 2*a*, 2*b* (and the tubes 5, 6) are reinforcing plates 9 which extend perpendicularly to the support carriers 7 and are connected thereto.

Figure 2:
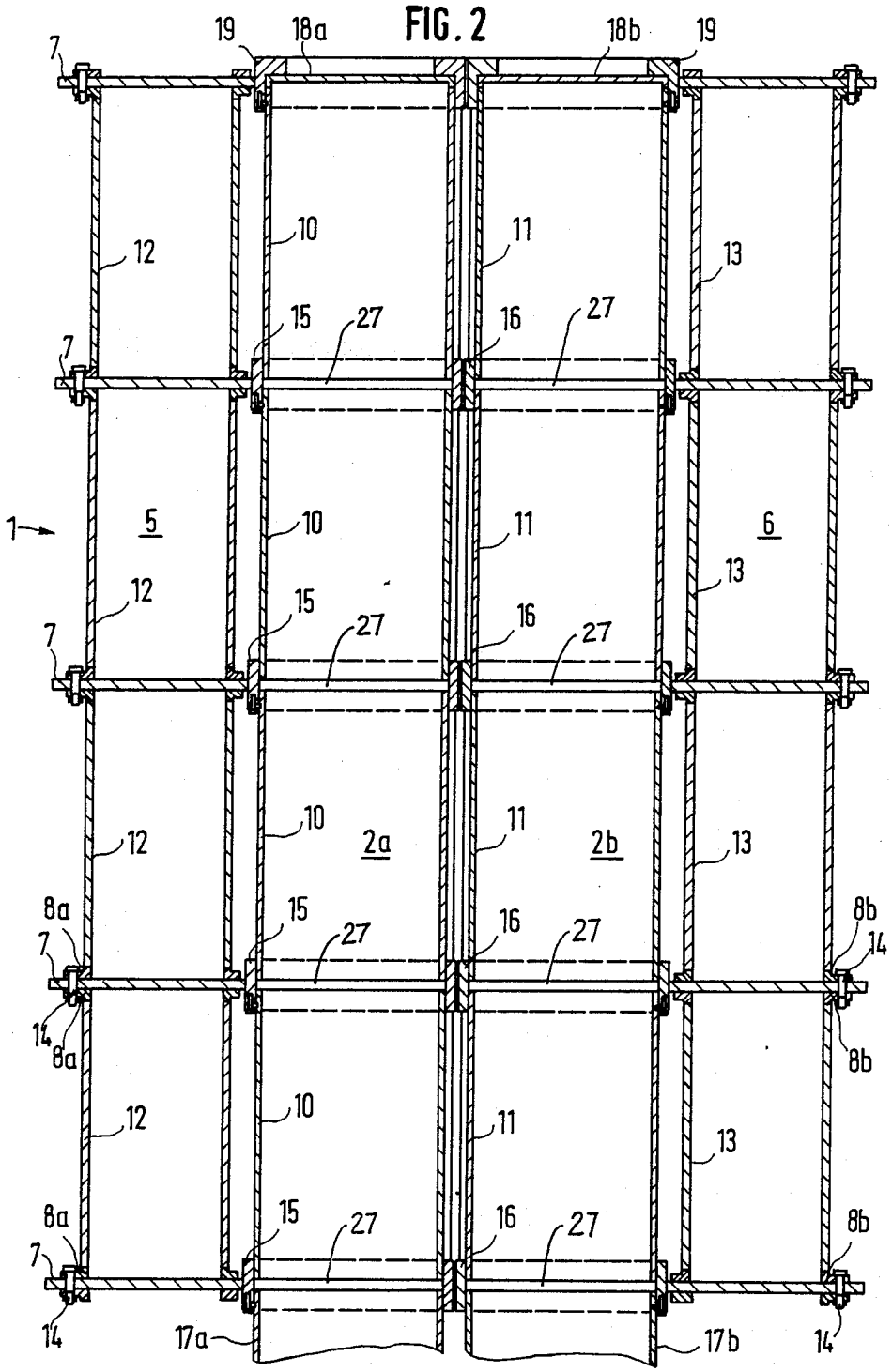
FIG. 2 is a longitudinal section through the heat exchanger of FIG. 1.

In a longitudinal section through heat exchanger 1, as shown in FIG. 2, it can be seen that each of the manifold ducts 2*a*, 2*b* comprises a number of axial duct segments 10 and 11 arranged one after the other. The support carriers 7, in the form of plates, are mounted at the joints between adjacent duct segments 10, 11, and the carriers each have two apertures 27 and guide sleeves 15, 16 for receiving and guiding the manifold ducts 2*a*, 2*b*.

Support tubes 5 and 6 are also comprised of individual segments, namely respective support tube segments 12, 13, which are approximately the same length as the duct segments 10, 11. In contrast to the duct segments 10, 11, the interior space of support tube segments 12, 13, need not be joined together and consequently the support carriers 7 have no corresponding apertures for the support tube segments 12, 13. For purposes of reducing the weight of the carriers 7, holes may be provided. The attachment flanges 8*a*, 8*b*, are welded to the ends of the support tube segments 12, 13, and the support tube segments 12, 13 are secured to the support carriers 7 by fasteners 14 which engage the attachment flanges of adjacent tube segments. Support tubes 5, 6, support carrier 7, and reinforcing plates 9 form the support frame means which supports heat exchanger 1, and the support frame means is, itself, supported by local attachments including fastening devices attached to an external support means (not shown).

Guide sleeves 15, 16 are secured to support carriers 7 around the apertures 27 so that the duct segments 10, 11 can be guided by sleeves 15, 16 when the duct segments are introduced into the apertures 27.

Manifold ducts 2*a*, 2*b* are provided at one end with respective connecting fittings 17*a*, 17*b* for the inlet or outlet of the heat exchanging fluid, and at the other end of the ducts respective bottom walls 18*a*, 18*b* are welded to the last axial duct segments 10, 11. Each wall is braced by a respective end piece 19 attached to the last support carrier 7.

Figure 3:
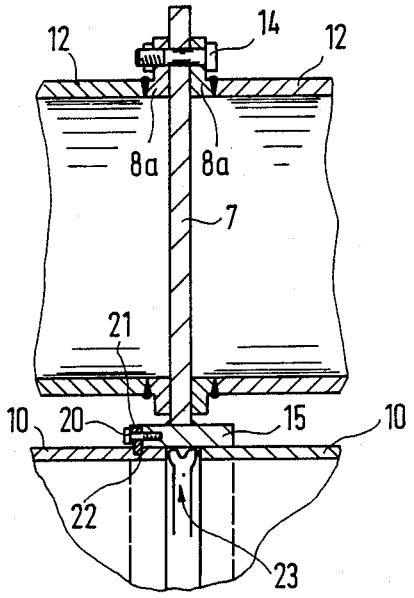
FIG. 3 is a sectional view of a detail in FIG. 2 on enlarged scale.

In the enlarged section shown in FIG. 3, the support duct segments 10 in guide sleeve 15 are visible. The guide sleeve 15 is welded to support carrier 7 and is joined by an annular key element 21 to a respective duct segment 10. The key element 21 is engaged in a correspondingly shaped slot 22 in the duct segment to provide a releasable connection of the carrier in the one of the adjacent ends of the duct segments 10. Thus, forces applied to the ducts are transferred to the support carriers 7 by means of guide sleeve 15 and then to support tube segments 12.

The annular key element 21 is secured to the guide sleeve 15 by fasteners 20 which permits detachment of the duct segments 10 from the carriers 7 for replacement purposes. By guiding the ends of the duct segments in sleeves 15 and connecting each duct segment to a respective carrier at one of its ends, the duct segments are free to expand and contract at their facing ends. In order to accommodate such axial expansion and contraction, the facing ends of the adjoining duct segments have a clearance therebetween in which an axial elastic metal ring seal 23 is mounted. The seal ring 23 is a conventional metal bellows to preserve the sealing relation between the ends of the duct segments during expansion and contraction.

Figure 4:
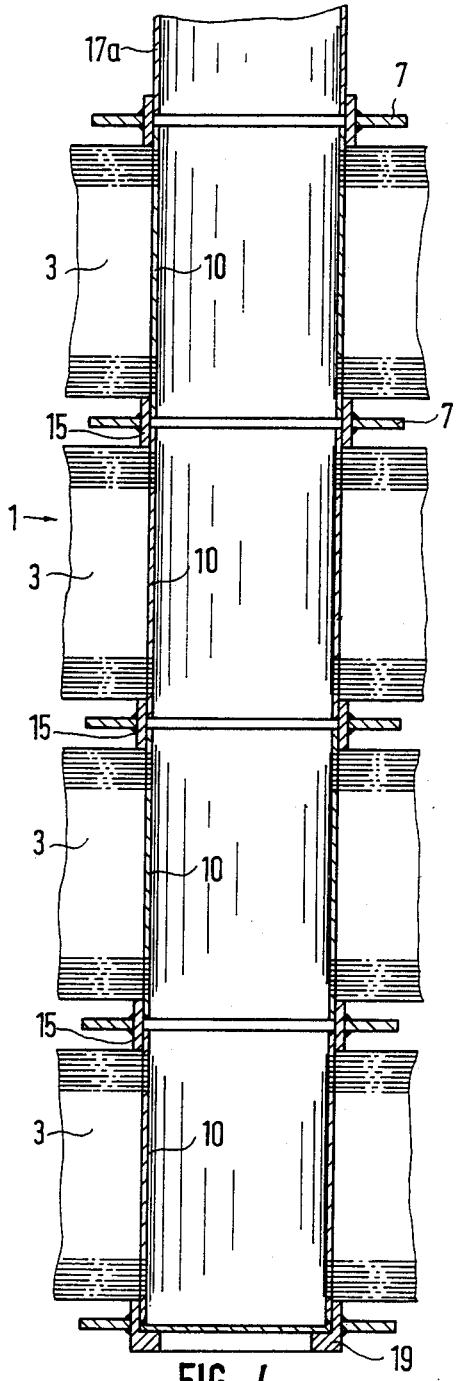
FIG. 4 is a longitudinal section through a manifold duct of the heat exchanger.

In another longitudinal section through heat exchanger 1 as shown in FIG. 4, which is perpendicular to the section in FIG. 2, it can be seen how individual tube matrixes 3 are mounted on the individual segments 10.

Figure 5:
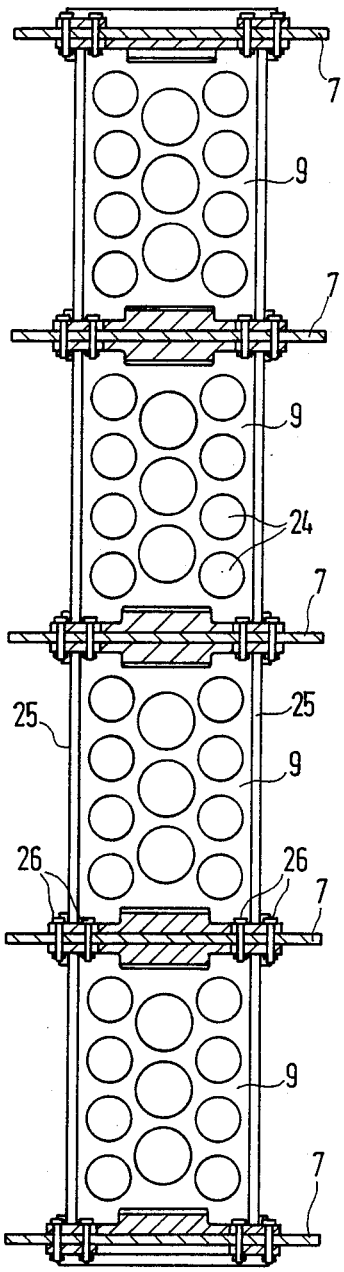
FIG. 5 is a sectional view which shows reinforcing plates.

The reinforcing plates 9 extend between successive individual support carriers and are shown in more detail in FIG. 5. The plates 9 have a number of apertures 24 in order to reduce their weight and the plates 9 have ribs 25 which form an H-shaped cross section to increase resistance of the plates to buckling. The H-section of the reinforcing plate 9 is better shown in FIG. 1. The reinforcing plates 9 are secured by bolts 26 to the support carriers 7.

Figure 6:
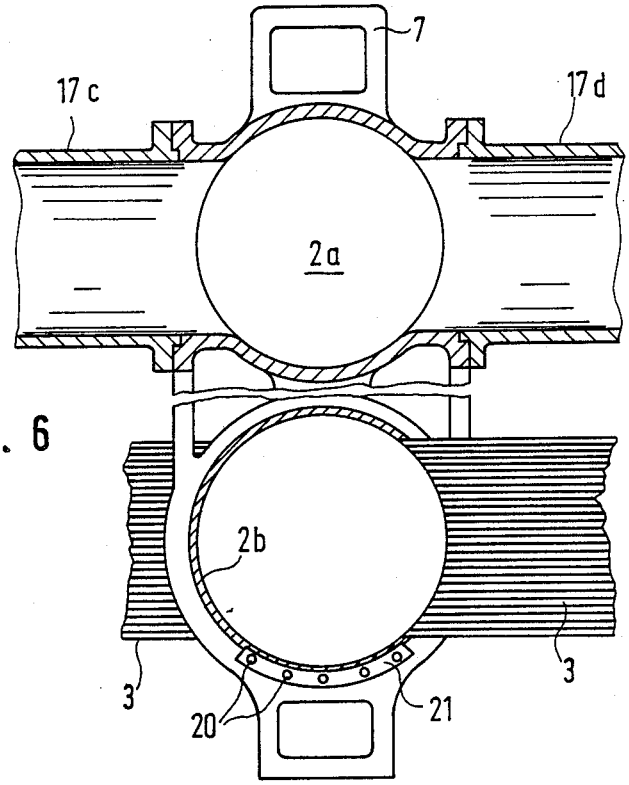
FIG. 6 is a transverse cross section through another embodiment of the heat exchanger.

An alternative embodiment is shown in FIG. 6, wherein the support carrier 7 is a cast part. At the upper duct 2*a*, another embodiment of the invention is also shown, in which, connecting fittings 17*c*, 17*d* are provided, not at an axial end of the ducts 2*a*, 2*b*, as in the previous embodiment shown in FIG. 2, but rather the fittings are disposed midway along the length of the ducts 2*a*, 2*b* and extend perpendicularly thereof. At the lower duct 2*b* in FIG. 6 can be seen key element 21 by means of which duct 2*b* is attached to support carrier 7 by fasteners 20.

Although the invention has been described in relation to specific embodiments thereof, it will become apparent to those skilled in the art that numerous modifications and variations can be made within the scope and spirit of the invention as defined in the attached claims.

What is claimed is:

1. A heat exchanger comprising two substantially parallel manifold ducts, a plurality of heat exchange tubes connected to said ducts and arranged in bundles extending axially of the ducts, each manifold duct comprising a plurality of axially aligned duct segments sealably connected to one another, and support frame means external of said ducts for guidably supporting each of the duct segments in the region of the ends thereof at which one duct segment faces the next, said support frame means comprising means for securing each duct segment at one end thereof to said support frame means, longitudinal support means extending parallel to said ducts, and a plurality of axially spaced support carriers to which said longitudinal support means is secured, said support carriers supporting said manifold ducts in said regions where the ends of said duct segments face one another.

2. A heat exchanger as claimed in claim 1 wherein said longitudinal support means comprises a longitudinal tube.

3. A heat exchanger as claimed in claim 1 wherein said longitudinal support means comprises two parallel, longitudinal support tubes spaced transversely with said manifold ducts disposed between said tubes in parallel relation thereto, said support tubes being secured to and supported by said support carriers, each duct segment being secured to a respective support carrier.

4. A heat exchanger as claimed in claim 3 comprising axial elastic sealing rings mounted between adjacent duct segments.

5. A heat exchanger as claimed in claim 4 wherein each said sealing ring comprises metal bellows.

6. A heat exchanger as claimed in claim 4 wherein said sealing rings are disposed in the region of said support carriers.

7. A heat exchanger as claimed in claim 3 wherein each support tube comprises a plurality of individual tube segments, each disposed between and secured to two successive support carriers.

8. A heat exchanger as claimed in claim 3 wherein each support carrier comprises a cast element.

9. A heat exchanger as claimed in claim 3 wherein each support carrier comprises a plate.

10. A heat exchanger as claimed in claim 3 wherein each tube is of rounded or rectangular form.

11. A heat exchanger as claimed in claim 3 wherein said ducts and said tubes have longitudinal axes disposed in a common plane.

12. A heat exchanger as claimed in claim 11 comprising reinforcing plates disposed between said ducts perpendicular to said common plane, said reinforcing plates being secured to successive support carriers.

13. A heat exchanger as claimed in claim 7 comprising guide sleeves secured to said support carriers and surrounding the facing ends of adjacent duct segments, and securing means detachably securing said guide sleeves to said duct segments.

14. A heat exchanger as claimed in claim 13 wherein said securing means secures each said guide sleeve to one of said adjacent duct segments so that each duct segment is secured at one end to a respective guide sleeve while its other end is slidably guided in the next successive guide sleeve.

15. A heat exchanger as claim in claim 1 comprising two connecting fittings on said manifold ducts for connection of said ducts to an inlet and an outlet for fluid.

16. A heat exchanger as claimed in claim 15 wherein said connecting fittings are adjacent one another and axially aligned with respective manifold ducts.

17. A heat exchanger as claimed in claim 15 wherein said connecting fittings extend transversely of said ducts.

18. A heat exchanger as claimed in claim 1 wherein said support carriers are provided with apertures through which said manifold ducts extend.

* * * * *